US007399208B2

(12) United States Patent
Schmidt

(10) Patent No.: US 7,399,208 B2
(45) Date of Patent: Jul. 15, 2008

(54) DEVICE FOR AN AXIALLY SLIDABLE CABLE IN A CONNECTOR HOUSING

(75) Inventor: Martin Schmidt, Luebbecke (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/559,218

(22) Filed: Nov. 13, 2006

(65) Prior Publication Data

US 2007/0128901 A1 Jun. 7, 2007

(30) Foreign Application Priority Data

Dec. 6, 2005 (DE) ..... 20 2005 019 035 U

(51) Int. Cl.
*H01R 13/62* (2006.01)

(52) U.S. Cl. ..... 439/578

(58) Field of Classification Search ..... 439/578, 439/583, 246–248, 157
See application file for complete search history.

(56) References Cited

U.S. PATENT DOCUMENTS 4,697,859 A * 10/1987 Fisher, Jr. ..... 439/246

* cited by examiner

*Primary Examiner*—Alexander Gilman
(74) *Attorney, Agent, or Firm*—Hayes Soloway P.C.

(57) ABSTRACT

In order to realize a connector housing (10) that is tightly sealed relative to the environment, there is provided a device for an axially slidable connector-ended cable (5) because a contact holder (20) connected to the connector-ended cable can be displaced by a defined axial distance (C) within the connector housing, wherein a constant pressure is exerted upon the contact holder (35) of a corresponding female connector (3) by means of an integrated pressure spring (40).

14 Claims, 3 Drawing Sheets

DEVICE FOR AN AXIALLY SLIDABLE CABLE IN A CONNECTOR HOUSING

BACKGROUND OF THE INVENTION

1. Field of the Invention

The invention pertains to a device for a contact holder with a connector-ended cable that is arranged within a connector housing in an axially slidable fashion.

A connector housing of this type is required in order to also utilize connectors with their own contact latching mechanisms in an industrial environment.

2. Description of the Related Art

There exist numerous connectors that feature a latching mechanism arranged for a definite overlapping contact area or to compensate tolerances between the contacts.

These latching mechanisms secure the end position in the mated state. When the connection is produced, the contact pairs are joined and the connectors are held against one another by pressure springs. The latching is achieved with displaceable holding means in this case. The housing of the connector carries out a movement relative to the contact and therefore the connected cable.

This displacement is only possible if the connectors are designed in a half-enclosed fashion and is quite common in offices—where they are not subjected to any dust and water.

However, if a higher degree of protection with a housing that provides additional protection and features its own latching mechanism and with a sealing contour is required, a relative movement between the contact and the contact latching mechanism is no longer possible.

SUMMARY OF THE INVENTION

Consequently, the invention is based on the objective of designing a connector housing of the initially cited type in such a way that the contact holder with the cable connected thereto carries out a displacement in the mating direction within the connector housing.

This objective is attained in that the connector housing features a sliding sleeve, in which the connector-ended cable is fixed, in that the sliding sleeve features locking devices that point into the connector housing, in that the contact holder is held between the locking devices, in that the contact holder is connected to the connector-ended cable, and in that the contact holder is displaceably guided within a recess in the connector housing.

The advantages attained with the invention can be seen, in particular, in that the connector housing accommodates a contact holder that is connected to an electric cable and able to carry out an axial relative movement within the connector housing in order to offset the tolerance on a female connector and able to accommodate connectors with their own contact latching mechanism.

In this case, an extension is integrally moulded onto the connector housing at the end on the cable side and a circumferential gasket is arranged in a groove on said extension, wherein a sliding sleeve is slipped over this extension. The sliding sleeve features a holding device that is formed by several tongue-shaped locking devices or guide rails, respectively. The locking devices extend through an opening in the connector housing and engage on the edges of the opening with hooks provided for this purpose such that the sliding sleeve is held in a captive fashion, wherein it is proposed to arrange the hooks on the quick-release hooks in such a way that a displacement between the connector housing and the sliding sleeve is possible over a predetermined distance.

The two guide rails are simultaneously guided in corresponding guide grooves in the collar of the connector housing and advantageously prevent the sliding sleeve from being turned relative to the connector housing. An electric cable fixed within the sliding sleeve by means of a strain relief and a gland nut can be displaced relative to the connector housing by the predetermined distance, wherein a connector enclosure that provides an advantageous seal relative to the environment is formed due to the sealing effect of the circumferential gasket on the collar of the connector housing and the sliding sleeve, and wherein the high extraction forces for the electric cable are simultaneously preserved.

In addition, a contact holder interposed between the locking devices of the sliding sleeve is held in an axially displaceable fashion in a recess in the panel of the connector housing. In this case, the sliding way of the contact holder advantageously corresponds to the sliding way of the sliding sleeve. A spring that surrounds the contact holder may be additionally arranged between the contact holder and the connector housing such that it continuously presses the contact holder in the mating direction. When the connector housing is connected to a female connector, the contact holder is continuously and steadily pressed against the female connector.

BRIEF DESCRIPTION OF THE DRAWINGS

One embodiment of the invention is illustrated in the figures and described in greater detail below. The figure show.

DETAILED DESCRIPTION OF THE INVENTION

Figure 1:
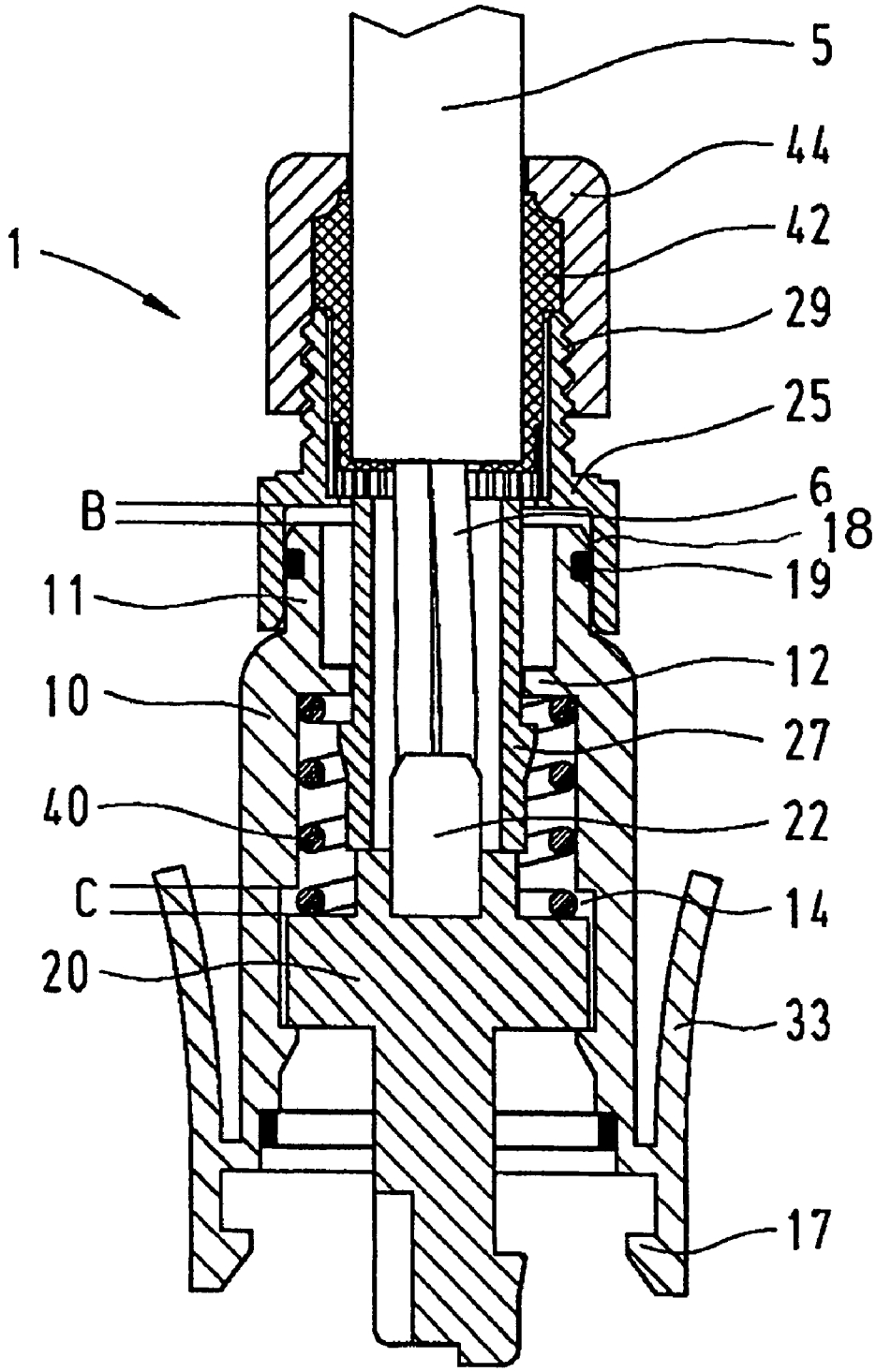
FIG. 1 a section through a connector housing in the non-mated position.

FIG. 1 shows a section through a connector 1 with a connector housing 10 that features a device for axially or slidably displacing an electric cable 5.

The mating side of the connector housing 10 is provided with integral latching elements for fixing the connector housing on a female connector.

A sliding sleeve 25 is slipped on a collar 11 of the connector housing 10 on the cable side. Several locking devices 26 are integrally moulded onto the sliding sleeve and extend into the connector housing 10 through an opening 13. Quick-release hooks 27 are provided on at least two locking devices and serve for holding the sliding sleeve on the rear panel 12 of the connector housing in a captive fashion. In this case, the hooks are arranged such that the sliding sleeve can be axially displaced relative to the connector housing by a certain distance C.

The contact holder 20 with a part 22 integrally moulded thereon is inserted between the locking devices. The contact holder is simultaneously guided in a recess 14 in the panel of the connector housing.

The sliding way C within the recess 14 corresponds to the sliding way C provided for the sliding sleeve, wherein the distance B between the collar 11 and the sliding sleeve is irrelevant in this case.

Between the contact holder 20 and the rear panel 12 of the connector housing 10, a pressure spring 40 is arranged around the part 22 of the contact holder and the locking devices 26 in such a way that the contact holder is continuously pressed against the lower stopping edge 16 of the recess 14 in the mating direction.

The spring 40 can be optionally utilized in this case.

The sliding sleeve 25 is slipped on the collar 11 of the connector housing 10 on the cable side, wherein their intermediate space is sealed against environmental influences by means of a circumferential gasket 19 arranged in a groove 18.

The electric cable 5 with its individual wires 6 is guided in the sliding sleeve 25 within a strain relief 42 and can be fixed by means of a gland nut 44 that is screwed on externally.

Figure 2:
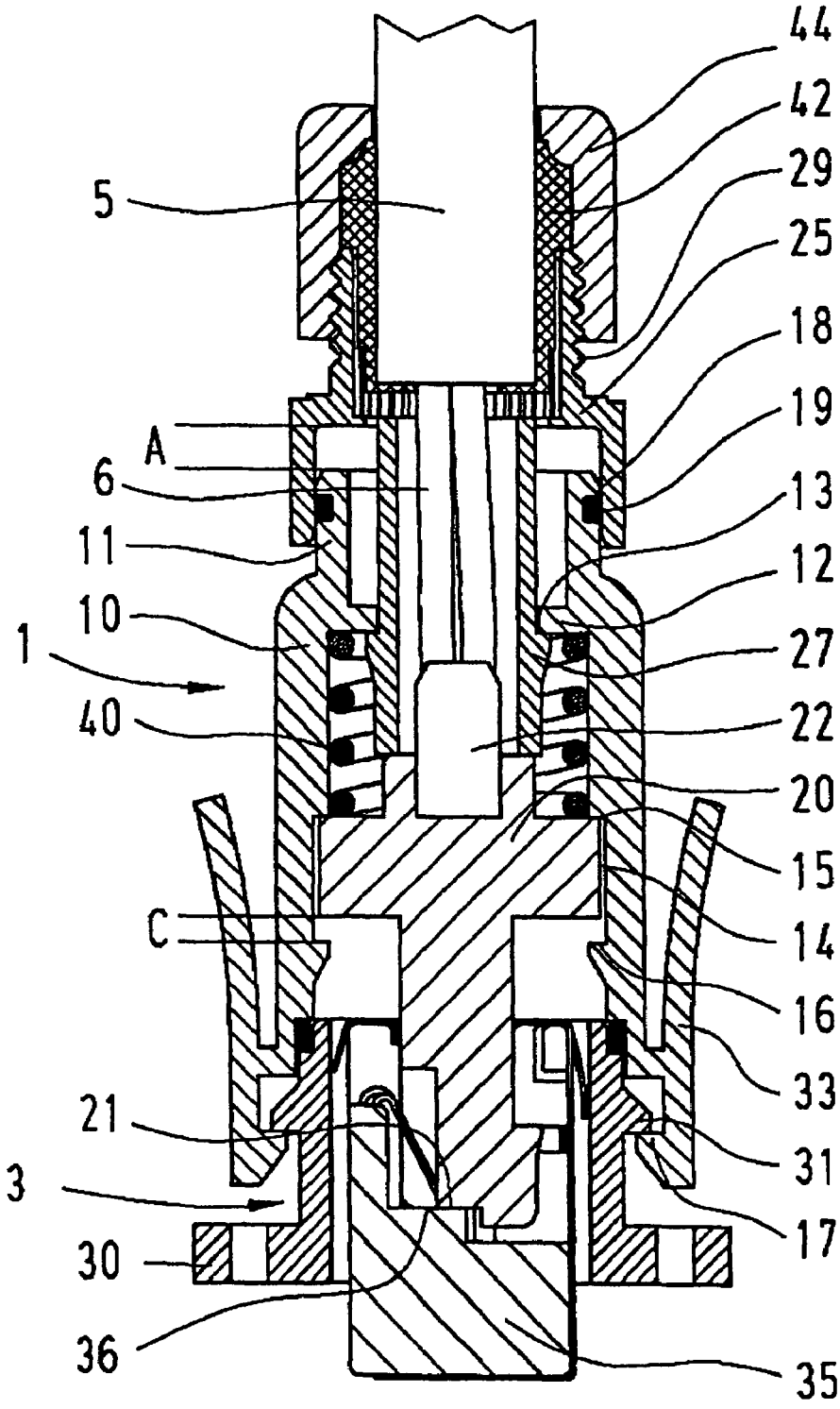
FIG. 2 a section through a connector housing in the mated position.

FIG. 2 shows the connector 10 in a position in which it is mated with a female connector 35 arranged in a gasket housing 30, wherein both connectors are interconnected by means of snap-on means in the form of snap-fits 17, 31.

The snap-fits 31, 17 are disengaged by pressing together the two laterally arranged unlocking devices 33 such that the connector 1 can be detached from the gasket housing 30.

In this mated state, both contact holders exactly adjoin one another with their pressure areas 21, 36, wherein the upper contact holder 20 contacts the upper stopping edge 15 of the recess 14 due to the contact pressure of the female connector.

However, the contact holder 20 is at least pressed against the lower female connector 35 by the spring 40.

One can also recognize the increased distance (A) between the extension on the end of the male connector on the cable side and the sliding sleeve, wherein this increased distance makes it clear why the electric cable 5 needs to be displaceable by a certain distance within the male connector.

Figure 3A:
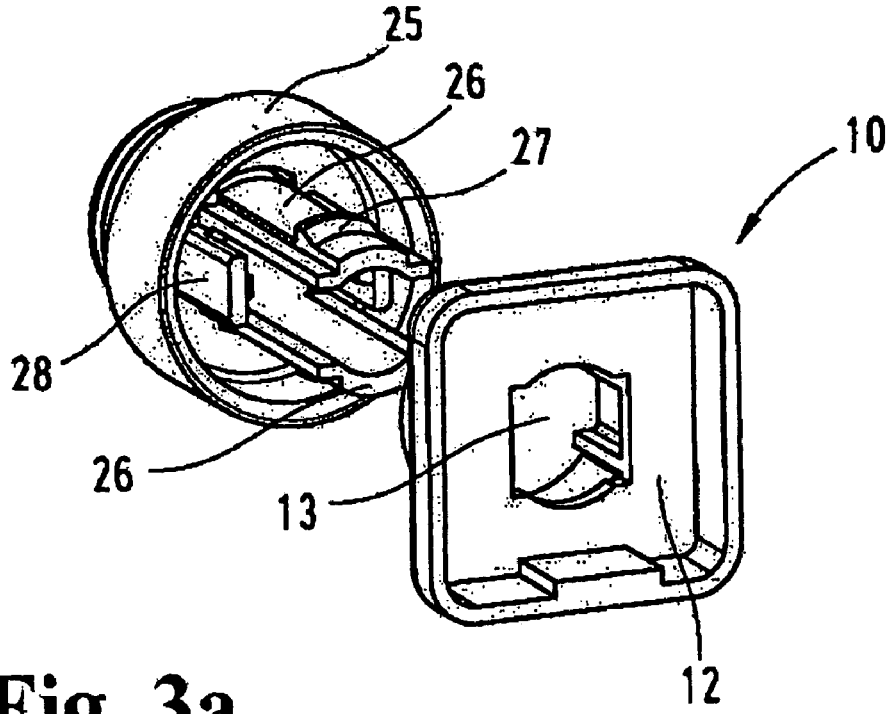
FIGS. 3*a, b* different views of a connector housing end and a sliding sleeve that can be slipped thereon.
Figure 3B:
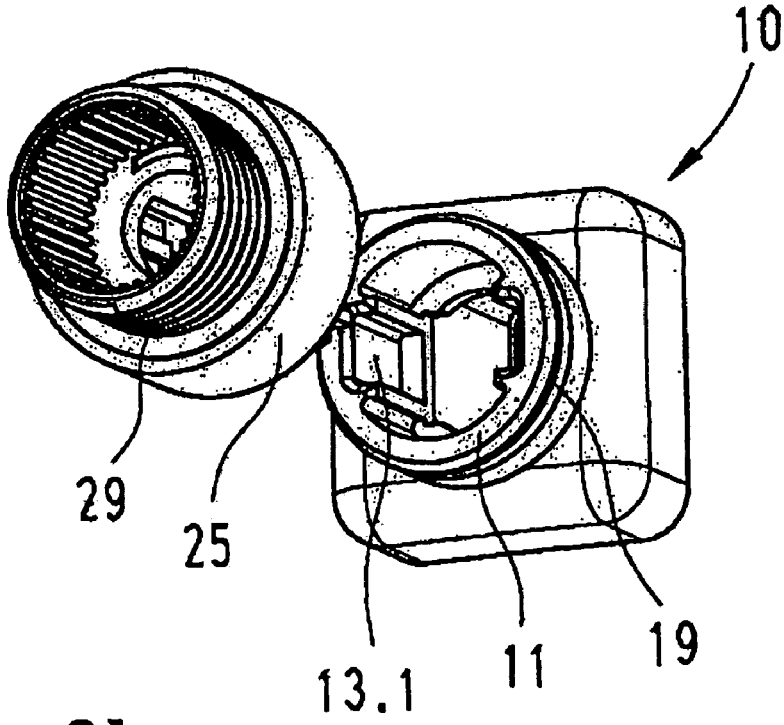

FIGS. 3*a*, 3*b* show the end of the connector housing on the cable side, wherein the region of the housing on the mating side is blanked out or cut off, respectively.

In this case, FIG. 3*a* shows a view of the connector housing 10 and the separate sliding sleeve 25 from the mating side while FIG. 3*b* shows a view of the sliding sleeve and the connector housing from the cable side. The sliding sleeve 25 features four stripped-shaped holding devices that protrude from the socket shape, wherein two oppositely arranged holding devices are realized in the form of extended tabs that form locking devices 26 and two shorter strips that are realized in the form of guide rails 28 are respectively guided in a guide groove 13.1 within the opening 13 such that the sliding sleeve 25 is non-rotatably held on the connector housing once the gland nut 44 is screwed on the thread 29 after the assembly of the cable set.

The guide rails are arranged in the extension of the connector that is formed by the collar 11, wherein the locking devices 26 protrude through the opening 13 and prevent the sliding sleeve from falling out of the opening by means of quick-release hooks 27 integrally moulded thereon when the quick-release hooks engage on the edge of the opening 13 in the rear panel 12. During the connector assembly, the part 22 of the contact holder 20 is positioned between the two locking devices 26 such that the locking devices are continuously spread apart.

What is claimed is:

1. A device for an axially slidable connector-ended cable on a contact holder that is displaceably arranged within a connector housing, wherein a sliding sleeve is provided on the connector housing and the connector-ended cable is fixed in said sliding sleeve, wherein the sliding sleeve has integrally molded locking devices that extend into the connector housing, wherein the contact holder is held between the locking devices, wherein the contact holder is connected to the connector-ended cable, and wherein the contact holder is guided in an axially displaceable fashion within a recess in the connector housing.

2. The device according to claim 1, wherein the sliding sleeve is held in an opening at the end of the connector housing on the cable side by quick-release hooks arranged on the locking devices.

3. The device according to claim 1, wherein the connector housing features a collar with a circumferential gasket, on which the sliding sleeve is arranged in an axially displaceable fashion.

4. The device according to claim 1, wherein the connector housing and the gasket housing of the female connector can be engaged by snap-fits.

5. The device according to claim 1, wherein the contact holder is pressed in the mating direction by a spring.

6. The device according to claim 1, wherein guide grooves are provided within the opening of the connector housing on the cable side, wherein the sliding sleeve is non-rotatably held in said guide grooves by guide rails.

7. A device for an axially slidable connector-ended cable on a contact holder that is displaceably arranged within an enclosed connector housing, comprising a sliding sleeve provided on the enclosed connector housing, the connector-ended cable being fixed in the sliding sleeve, wherein the sliding sleeve has a strain relief and a gland nut provided on a cable side of the sliding sleeve, and wherein the contact holder is connected to the connector-ended cable, and wherein the contact holder is guided in an axially displaceable fashion within a recess in the enclosed connector housing.

8. The device according to claim 7, wherein the connector housing features a collar with a circumferential gasket, on which the sliding sleeve is arranged in an axially displaceable fashion.

9. The device according to claim 7, wherein the contact holder is pressed in a mating direction by a spring.

10. A device for an axially slidable connector-ended cable on a contact holder that is displaceably arranged within a connector housing, wherein a sliding sleeve is provided on the connector housing and the connector-ended cable is fixed in said sliding sleeve, wherein the sliding sleeve features locking devices that point into the connector housing, wherein the contact holder is held between the locking devices, wherein the contact holder is connected to the connector-ended cable, wherein the contact holder is guided in an axially displaceable fashion within a recess in the connector housing, and wherein guide grooves are provided within the opening of the connector housing on the cable side, wherein the sliding sleeve is non-rotatably held in said guide grooves by guide rails.

11. The device according to claim 10, wherein the sliding sleeve is held in an opening at the end of the connector housing on the cable side by quick-release hooks arranged on the locking devices.

12. The device according to claim 10, wherein the connector housing features a collar with a circumferential gasket, on which the sliding sleeve is arranged in an axially displaceable fashion.

13. The device according to claim 10, wherein the connector housing and the gasket housing of the female connector can be engaged by snap-fits.

14. The device according to claim 10, wherein the contact holder is pressed in the mating direction by a spring.

* * * * *